United States Patent [19]

Watanabe et al.

[11] Patent Number: 4,542,084

[45] Date of Patent: Sep. 17, 1985

[54] METHOD FOR FORMING A COLORED IMAGE

[75] Inventors: Haruo Watanabe; Junetsu Seto, both of Kanagawa; Kiyosuke Suzuki, Saitama; Toshiaki Fukuma, Tokyo, all of Japan

[73] Assignee: Sony Corporation, Tokyo, Japan

[21] Appl. No.: 634,151

[22] Filed: Jul. 25, 1984

[51] Int. Cl.[4] ..... G03G 13/01

[52] U.S. Cl. ..... 430/46; 430/42; 430/901

[58] Field of Search ..... 430/42, 46, 901; 355/4

[56] References Cited

U.S. PATENT DOCUMENTS

| | | | |
|---|---|---|---|
| 2,940,847 | 6/1960 | Kaprelian | 430/42 X |
| 4,493,881 | 1/1985 | Mitchell et al. | 430/42 |

FOREIGN PATENT DOCUMENTS

| | | | |
|---|---|---|---|
| 855153 | 11/1970 | Canada | 430/46 |
| 2357099 | 5/1974 | Fed. Rep. of Germany | 430/42 |
| 1055321 | 1/1967 | United Kingdom | 430/901 |

OTHER PUBLICATIONS

Newman, "The Science and Art of Xerography–Part III", Brit. Jour. Phot., Oct. 9, 1964, p. 828.

Mannheim, "Electrophotographic Colour", Camera, Apr. 1966, pp. 69–72.

*Primary Examiner*—Roland E. Martin

*Attorney, Agent, or Firm*—Hill, Van Santen, Steadman & Simpson

[57] ABSTRACT

A method for forming a color image includes a step of spraying three kinds of photoconductive toners with a sensitization wavelength band different from its absorption wavelength band, a step of electrically charging these different toners, a step of exposing these sprayed and electrically charged photoconductive toners to light for selectively removing electrostatic charges, and a step of removing the toners freed of electrostatic charges from the substrate. The magenta color photoconductive toners sensitive to red light, yellow color photoconductive toners sensitive to green light, and the cyan color photoconductive toners sensitive to blue light, are used as aforementioned three kinds of photoconductive colors.

8 Claims, 23 Drawing Figures

METHOD FOR FORMING A COLORED IMAGE

BACKGROUND OF THE INVENTION

1. Field of the Invention

This invention relates to a method for forming a color image by using photoconductive toners and, more particularly, to a method for forming a highly sensitive color image by one shot of exposure to image-wise light.

2. Description of the Prior Art

Heretofore, various methods are known in the art for producing hard copies for preserving and handling electrical color image signals.

For example, it is known to provide colors corresponding to the image signals to the recording paper at coordinate positions thereof corresponding to original color signals, as for instance by spraying ink of a predetermined color (ink jet printing) or thermally developing a color on the recording paper (thermal coloring). In these methods, since coloring means are caused to mechanically sweep the recording paper along coordinate axes thereof for sequential image formation, a prolonged sweep time is required for producing an accurate color image. Moreover, a limitation is placed on the power of resolution as a function of the properties of the coloring means employed.

An electrophotographic process is also known in the art for shortening the image forming time interval and improving the power of resolution. However, in the conventional color electrophotographic process, three color toners are sequentially exposed, developed and fixed in three separate steps, thus complicating the image forming operation. Moreover, color filters are required for color separation, thus complicating the apparatus. In addition, there is the risk of color deviation from the original color.

For producing a color image by one shot exposure to light, methods are also known in the art by which particles containing colorless sublimable dyes are electrostatically deposited on a sensitized plate or photosensitive particles containing colorless sublimable dyes are electrostatically deposited on a photoconductive plate, after which the particles are exposed to light so that the dyes are caused to develop their color on the transfer sheet. In these methods, color images can be formed only on a special transfer sheet provided with a coloring layer of deposited organic or inorganic acids for coloring the colorless sublimable dyes, thus causing elevated costs. In addition, there is the risk of color fading because the dyes are only poor in durability.

SUMMARY OF THE INVENTION

It is an object of the present invention to provide an improved method for forming a color image.

It is another object of the present invention to provide a method for forming a color image in which a color image can be obtained by one shot of exposure to an image-wise light.

It is a further object of the present invention to provide a method for forming a color image which is clear and definite with little fogging.

It is a still further object of the present invention to provide a method for forming a color image at low cost.

According to one aspect of the present invention, there is provided a method for forming a color image which comprises the steps of:

(a) uniformly forming three kinds of photoconductive toners on a substrate, each of said photoconductive toners having an absorption wavelength band corresponding to one of red, green and blue light components of a natural light, each of said photoconductive toners having a sensitization wavelength band corresponding to one of red, green and blue light components of the natural light, and each of said photoconductive toners having said absorption wavelength band and said sensitization wavelength band different from each other;

(b) uniformly charging said photoconductive toners;

(c) obtaining three colors corresponding to three primary colors, that is, red, green and blue from an original image to be reproduced;

(d) converting said three primary colors into three primary colors mutually different therefrom;

(e) exposing said photoconductive toners to a light with each of the converted three primary colors for selectively removing charges from a portion of said photoconductive toners; and (f) removing toners freed of charges from said substrate.

According to another aspect of the present invention, there is provided a photosensitive material employed in the method for forming a color image which comprises a substrate and three kinds of photoconductive toners uniformly formed on said substrate, each of said photoconductive toners having an absorption wavelength band corresponding to one of red, green and blue light components of a natural light, each of said photoconductive toners having a sensitization wavelength band corresponding to one of red, green and blue light components of the natural light, and each of said photoconductive toners having said absorption wavelength band and said sensitization wavelength band different from each other.

BRIEF DESCRIPTION OF THE DRAWINGS

FIGS. 1 to 3 are schematic views for illustrating the relation between the sensitization wavelength band and the absorption wavelength band of the photoconductive toners, wherein

FIGS. 4 to 7 are diagrammatic views showing the process for forming a color image according to the present invention, wherein FIG. 4 shows the step of electrically charging photoconductive toners; FIG. 5 the step of light exposure of the electrostatically charged toners; FIG. 6 the step of removing the toners from which the charges have been lost; and FIG. 7 shows a step for thermally fixing the image on a substrate.

DETAILED DESCRIPTION OF THE INVENTION

In forming a color image by using the photoconductive toners, three-colored particles sensitive to the light of the red, green and blue wavelength bands are used as photoconductive toners. In this case, it is necessary to consider the relation between the absorption wavelength band responsible in determining the color proper to the toner and the sensitization wavelength band.

In the present specification, the sensitization wavelength band or range means the wavelength band by the irradiation of the light of which the toner is rendered conductive and loses its electrostatic charges.

When the photoconductive toners are colored in three primary colors of the additive color system, that is, red, green and blue, a color image composed of three colors, i.e. red, green and blue, is obtained as negative. However, in this case, the white and black image signal portions, for example, are respectively turned into black and white image signal portions (inversion of brightness).

On the other hand, when the light conductive toners are colored in the three primary colors of the subtractive color system, that is, cyan, magenta and yellow, a color image consisting of three colors, viz. red, green and blue, is obtained as positive and thus without brightness inversion.

When the photoconductive toners are colored in this manner in the three primary colors of the subtractive color system, three further combinations can be considered by taking the combination with the light intensifiers or sensitizers into account.

Figure 1A:
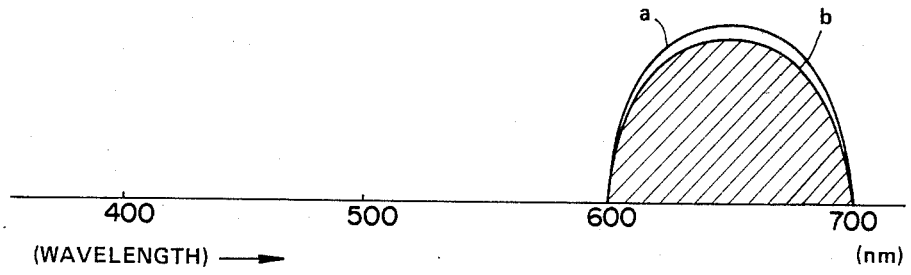
FIG. 1A shows the relation for photoconductive cyan toners sensitive to red light.
Figure 1B:
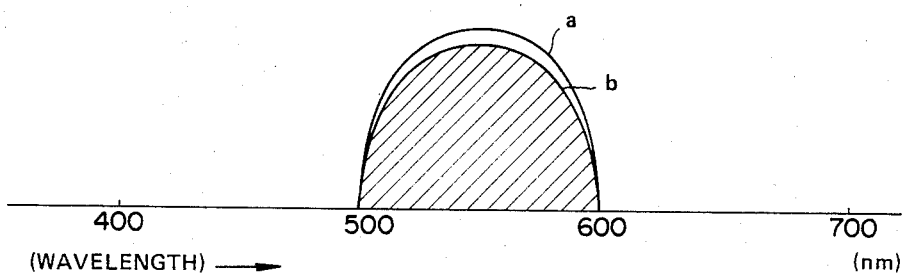
FIG. 1B that for photoconductive magenta toners sensitive to blue light.
Figure 1C:
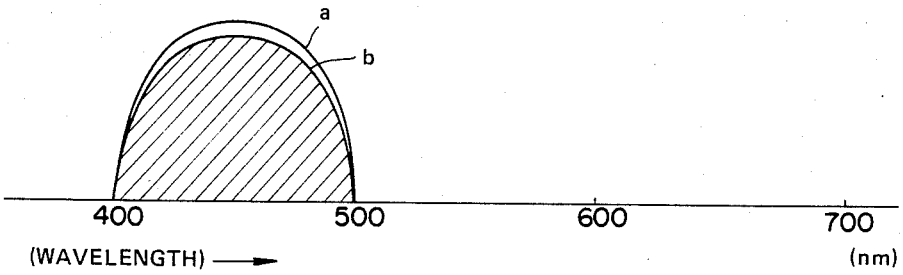
FIG. 1C that for photoconductive yellow toners sensitive to blue color.

A first combination is one of cyan color photoconductive toners sensitive to red light, magenta color photoconductive toners sensitive to green light, and yellow color photoconductive toners sensitive to blue light. In this case, a positive having the same color as that of the exposure light may be obtained, because the cyan color photoconductive toners are selectively removed upon exposure to red light so that a red color is exhibited by the remaining magenta and yellow color photoconductive toners. However, the sensitization wavelength bands a and the absorption wavelength bands b of these toners overlap one another, as shown diagrammatically in FIGS. 1A to 1C. Thus, with the cyan color photoconductive toners sensitive to red light, both the sensitivity and absorption wavelength bands a, b are 600 to 700 nm, as shown in FIG. 1A. Similarly, both the sensitivity and absorption wavelength bands a, b of the magenta color photoconductive toners are 500 to 600 nm, while those of the yellow color photoconductive toners are 400 to 500 nm, thus overlapping each other in either cases.

When the sensitivity and absorption wavelength bands thus overlap each other, the light of the wavelength to which the toners should be sensitive is absorbed by the toner coloring materials, so that sensitization is markedly lowered.

A second combination is one of magenta color photoconductive toners sensitive to red light, yellow color photoconductive toners sensitive to green light and cyan color photoconductive toners sensitive to blue light.

Figure 2A:
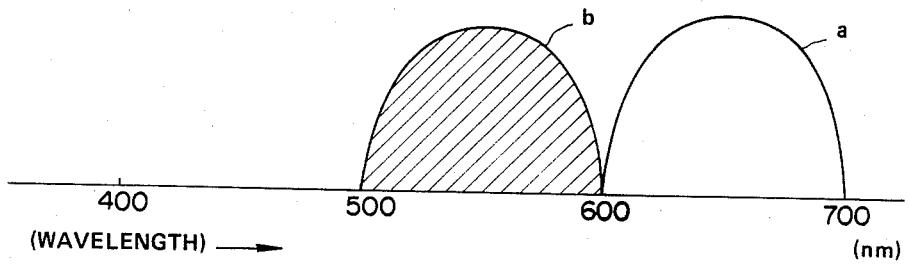
FIG. 2A that for photoconductive magenta color sensitive to red color.
Figure 2B:
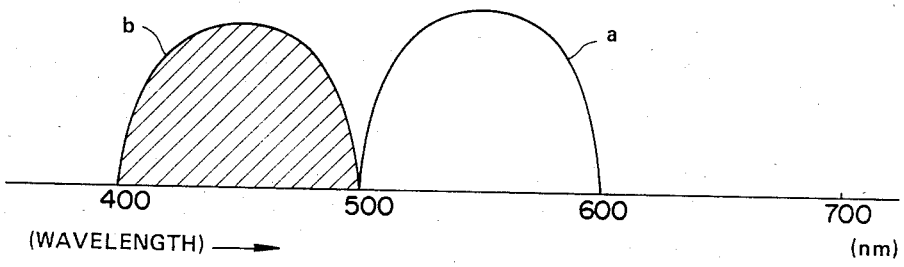
FIG. 2B that for photoconductive yellow toners sensitive to green light.
Figure 2C:
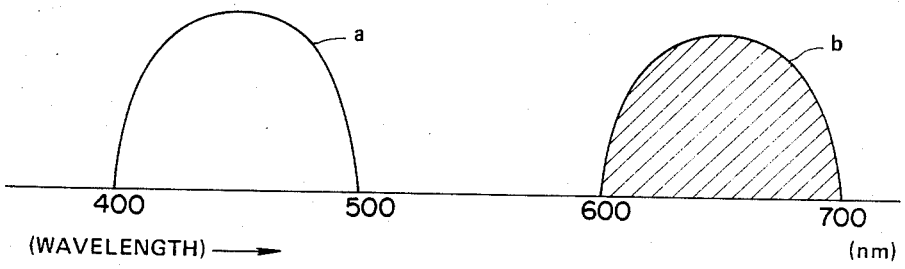
FIG. 2C that for photoconductive cyan toners sensitive to blue light.
Figure 3A:
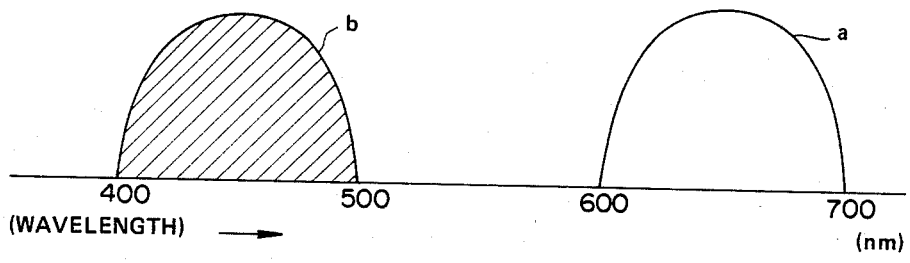
FIG. 3A that for photoconductive yellow toners sensitive to red light.
Figure 3B:
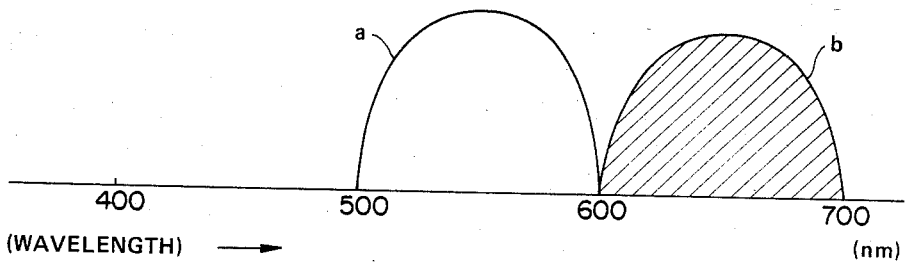
FIG. 3B that for photoconductive cyan toners sensitive to green light.
Figure 3C:
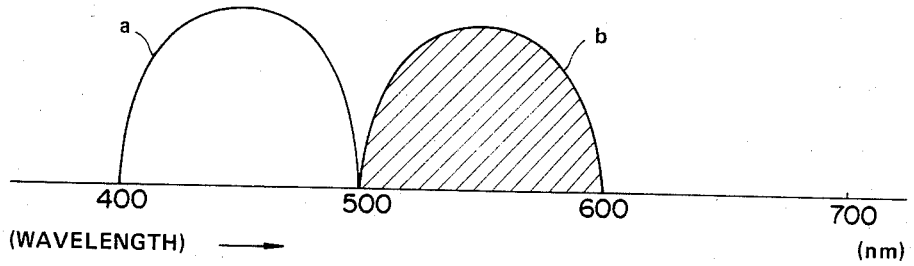
FIG. 3C that for photoconductive magenta toners sensitive to blue light.

A third combination is one of yellow color photoconductive toners sensitive to red light, cyan color photoconductive toners sensitive to green light and magenta color photoconductive toners sensitive to blue light. The sensitivity and absorption wavelength bands a, b of the respective toners of the second combination, are shown in FIGS. 2A to 2C, whereas the sensitivity and absorption wavelength bands a, b of the respective toners of the third combination are shown in FIGS. 3A to 3C. In any of these combinations, the sensitivity and absorption wavelength bands of the toners are obviously not overlapped with one another.

According to our experiments, spectral characteristics of light absorbance of the light sensitizer (i.e. sensitivity of the toner processed in accordance with the present invention) are such that toner sensitivity is suddenly lowered at the longer wavelength side of a critical wavelength corresponding to maximal sensitivity, whereas it is lowered slowly at the shorter wavelength side thereof thus showing a skirting and showing limited sensitivity to the light included in the skirting. Thus when the absorption wavelength range proper to the coloring material is set to be adjacent to the shorter wavelength side of the sensitization wavelength range, the material acts as filter for suppressing the sensitivity to the shorter wavelength light of the skirting and limiting the sensitization wavelength range to a narrow one thereby improving spectral characteristics.

Therefore, the second combination, that is, the combination of the magenta color photoconductive toners sensitive to red light, the yellow color photoconductive toners sensitive to green light and the cyan color photoconductive toners sensitive to blue light, is most preferred. Thus, as shown in FIG. 2A, the magenta color photoconductive toner has a sensitivity wavelength band a of 600 to 700 nm and an absorption wavelength band b of 500 to 600 nm adjacent to the short wavelength side of the band a. Thus, even when the sensitization wavelength band a shows skirting so that some sensitivity is exhibited to the light of the wavelength less than 600 nm, the band is overlapped with the absorption wavelength band b thus causing no inconvenience. The same may be said of yellow color photoconductive toners. The cyan color has a sensitization wavelength band of 400 to 500 nm which is at a considerably shorter wavelength side so that no inconvenience is caused by the aforementioned skirting.

It should be noted that, in using the magneta color photoconductive toners sensitive to red light (hereafter referred to as magneta color toners), the yellow color photoconductive toners sensitive to green light (hereafter referred to as yellow color toners) and the cyan color photoconductive toners sensitive to blue light (hereafter referred to as cyan color toners), image portions irradiated with red, green and blue light present green, blue and red colors, respectively. Therefore, for obtaining color matching between the color image signals and the duplicated image, it is necessary to convert red, green and blue signals into blue, red and green lights, respectively. As means for converting electrical color image signals into predetermined exposure light, a laser beam scanner, an array of light emitting diodes or a color CRT with signal conversion means, may be employed.

The process of forming a color image in accordance with the present invention is hereafter explained by referring to the drawings.

Figure 4:
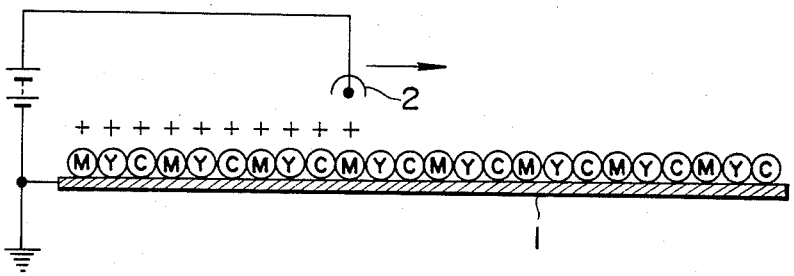

As shown in FIG. 4, magenta color toners M, yellow color toners Y and cyan color toners C are evenly sprayed on a photoconductive substrate 1, and are charged uniformly by using a corona charger 2. The toners are affixed to the substrate under electrostatic attraction.

Figure 5:
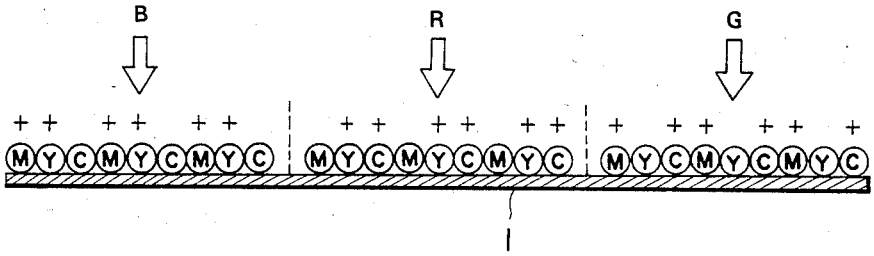

Then, as shown in FIG. 5, the light converted from electrical color image signals, such as blue light B converted from red signals, red light R converted from green signals and green light G converted from blue signals, are irradiated. By such irradiation, toners sensitive to the respective lights are selectively rendered electrically conductive so that their charges are lost and the force of electrostatic attraction relative to the substrate 1 is similarly lost. For example, in a zone irradiated with blue light B, the cyan color toners C absorb the light so that their charges are lost. Similarly, in a zone irradiated with red light R and a zone irradiated with green light G, charges on the magenta color toners M and on the yellow color toners Y are lost.

Figure 6:
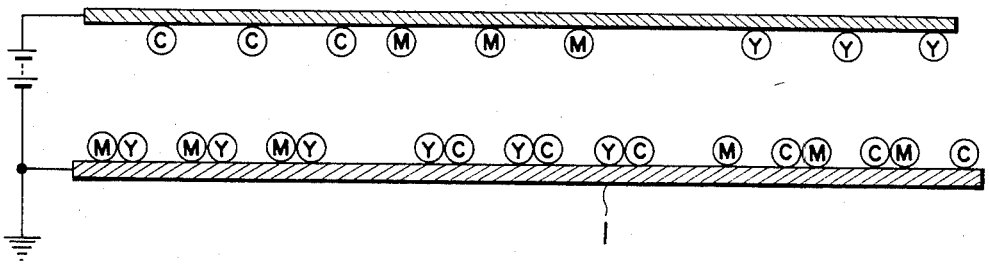

The toner particles from which the charges are lost in this manner and whose electrostatic attraction is reduced to nill may then be removed by electrical or mechanical means, as shown in FIG. 6. In this manner, a color image corresponding to the electrical color image signals is formed on the substrate 1. Thus the zone irradiated with the blue light B converted from red signals presents a red color because the magenta color toners M and the yellow color toners C remain after removal of the cyan color toners C. Similarly, the zone irradiated with red light R presents a green color because of the remaining cyan color toners C and the yellow color toners Y, while the zone irradiated with the green light G presents a blue color because of the remaining magenta color toners M and cyan color toners C.

Figure 7:
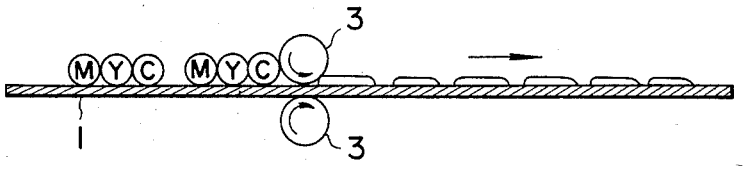

The color image thus obtained is then fixed by a fixing roll 3, as shown in FIG. 7.

Figure 8:
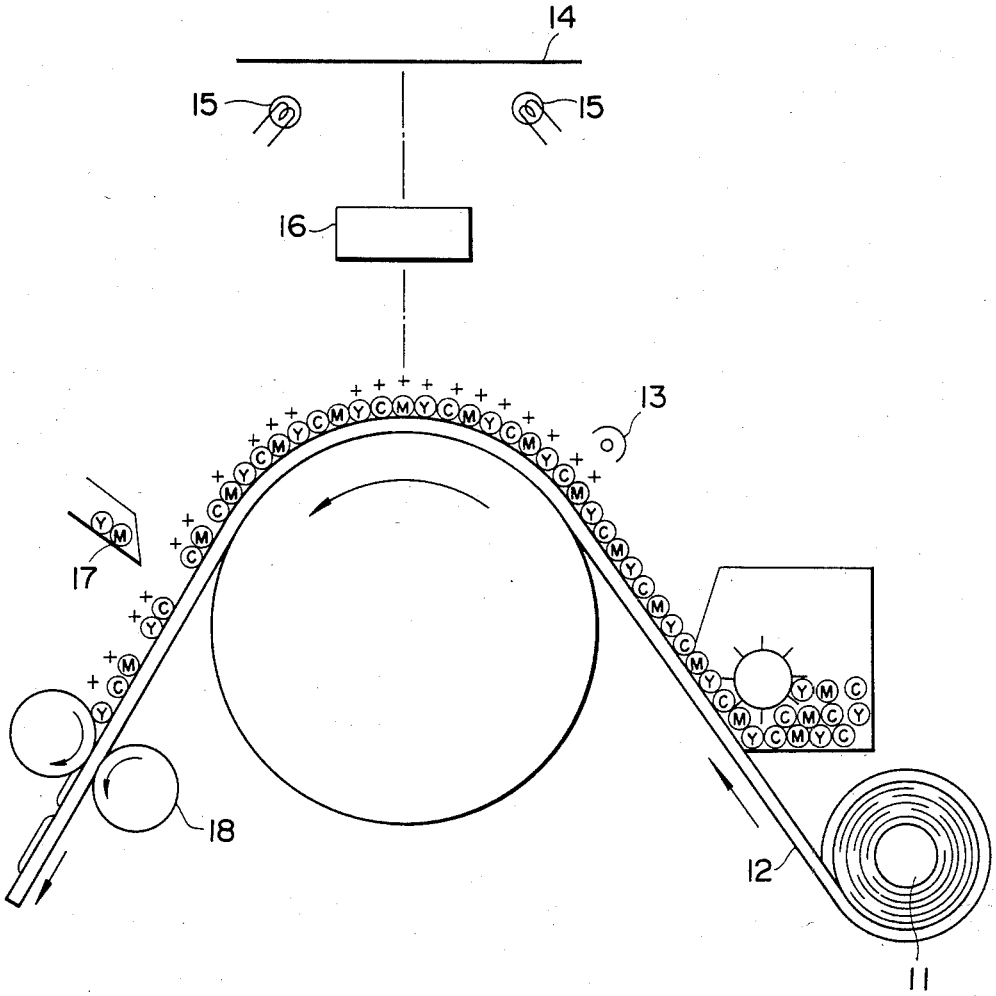
FIG. 8 is a diagrammatic view showing an example of a color duplicating apparatus adapted for continuous formation of color images.

The above described steps can be carried out in succession by using a color duplicator as shown in FIG. 8.

A recording paper 12 is continuously supplied from a supply roll 11, and a mixture of three color toners M, Y and C are sprayed uniformly on the paper 12. These toners M, Y and C are charged by a corona charger 13, after which the recording paper is exposed with light of predetermined color converted by a converter 16 from electrical color image signals obtained by irradiating an object 14 with light from a light source 15. The toner particles from which the charges are lost upon light exposure are attracted and removed by a nozzle 17, and the remaining toner particles are fixed by a fixing roll 18.

It is seen from above that a color image is formed in accordance with the present invention by using the magenta, yellow and cyan color toners for removing charges from selected photoconductive toners so that extremely clear and sensitive color image can be formed by a single exposure operation.

The photoconductive toners of the present invention may be formed by adding a light sensitizer, coloring material and a resinous binder to the photoconductive material, said binder serving for fixing the toner particles on the duplicating surface.

The photoconductive toners employed in the present invention are described hereafter in detail.

The magenta color toner sensitive to red light presents a hue belonging to a range of 1.0 RP to 5.0 R in the Munsell color notation system, and shows marked sensitivity to the visible light with wavelength higher than 600 nm (red light). It has a maximal point of sensitivity in the wavelength region of 610 to 650 nm, and more than 80 percent of sensitivity proper to the overall visible light region in the wavelength region of 600 to 700 nm.

As practical construction of the photoconductive toner, it is advisable to use a photoconductor exhibiting specific photoconductive properties in the wavelength region higher than 600 nm (red light) by addition of a red light intensifier or sensitizer, in which the photoconductor contains a coloring material exhibiting substantially negligible absorption of the visible light more than 600 nm in wavelength, but exhibiting absorptive properties for the wavelength region less than 600 nm and presenting the magenta hue as described above. With the above construction, the coloring material acts as filter with respect to photoconductivity of the photoconductor in the region less than 600 nm so that the photoconductor may exhibit photoconductivity only in the limited wavelength region of 600 to 700 nm. Since the above described magenta coloring material usually exhibits strong color absorption especially in the region of 500 to 600 nm, even if the photoconductor should still exhibit a useless sensitivity range towards the shorter wavelength side of the 600 to 700 nm region after addition of the red light intensifier, such useless sensitivity range is filtered off due to color absorption of the coloring material.

As photoconductor, materials such as sulphur, selenium, oxides, sulfides or selenides of zinc, cadmium, mercury, autimony, titanium, bismuth or lead, anthracene, anthraquinone, polyvinyl carbazol, polyvinyl anthracene, or polyacetylene may be used. The most preferred material is zinc oxide.

As red light intensifiers for the photoconductor, such materials may be used as Tetrabromophenol Blue, Bromophenol Blue, Bromocresol Purple, Bromochlorophenol Blue, Bromocresol Blue, Bromo Thymol Blue, Bromocresol Green, Tetraiodophenol Blue, Acid Blue 1, Acid Blue 7, Acid Blue 9, Acid Blue 103, Methylene Blue, Crystal Violet, Brilliant Green or Malachite Green. These red light intensifiers are added to the photoconductor in an amount of 0.01 to 1.0 wt. percent.

Hypersensitizers may be additionally used for promoting sensitization of the red light intensifier so as to provide for so-called hypersensitization. As these hypersensitizers, compounds showing electron affinity, such as benzoquinone, chloranil, phthalic anhydride, maleic anhydride, dinitrobenzoic acid or iodine may be employed. These hypersensitizer may be used in an amount of 0.01 to 1.0 wt. percent relative to the aforementioned photoconductor.

As coloring materials, inorganic pigments, organic pigments, direct dyes, acid dyes, basic dyes, disperse dyes or oil colors may be used singly or in combination and in consideration occasionally of the hue or the like factors. For example, inoranic pigments such as iron oxide red of the Pigment Red 101; organic pigments such as Pigment Red -1, -3, -4, -5, -6, -7, -8, -9, -12, -18, -22, -30, -32, -36, -38, -40, -48, -49, -50, -53, -54, -57, -58, -59, -60, -63, -64, -67, -81, -83, -90, -163, or -173; and organic pigments such as oil colors, for example, Solvent Red -1, -3, -8, -23, -24, -25, -27, -30, -49, -81, -82, -83, -84, -100, -109 or -121. These coloring materials may be used in amounts of 1.0 to 100 wt. percent related to the aforementioned photoconductor.

The aforementioned photoconductors, red light intensifiers and coloring materials are essential ingredients of the above described photoconductive toners. In addition to these essential ingredients, a resinous binder may be occasionally used for binding these ingredients to one another or promoting fixing on the duplicating medium. As such binder, thermoplastic resins such as acrylic resin, styrene resin, styrene-butadiene copolymer, polycarbonate resin, polyvinyl alcohol or polyvinyl acetate, or thermosetting resins such as urethane resin, epoxy resin or melamine resin, may be used either singly or in combination. These resins may be used in an amount of 2 to 50 wt. percent related to the aforementioned photoconductor.

The yellow color toner sensitive to green light has a hue in the range of 5.0 YR to 10.0 Y in the Munsell color notation system and sharp sensitivity to the visible light of the wavelength in the range of 500 to 600 nm (green light). As characteristic of the yellow color toner, it has a maximal point of sensitivity in the wavelength region of 520 to 560 nm and more than 80 percent of sensitivity proper to the visible light concentrated in the wavelength region of 550 to 580 nm.

In addition, the above described toner should have light absorptive characteristics such that preferably more than 80 percent of light absorption occurs in the visible light region with the wavelength less than 520 nm and more preferably more than 80 percent of light absorption occurs in the visible light region with the wavelength less than 500 nm.

As practical construction of these photoconductive toners, it is desirable to use a photoconductor exhibiting specific photoconductive properties in the wavelength region of 500 to 600 nm (green light) by addition of a green light intensifier or sensitizer, in which the photoconductor contains a yellow pigment or dye exhibiting substantially negligible absorption of the visible light more than 500 nm in wavelength and strong absorptive characteristics for the wavelength region less than 500 nm and presenting the above described hue, and a resinous binder for fixing. In this case, the yellow pigments or dyes act as filter with respect to photoconductive properties of the photoconductor in the wavelength region less than 500 nm in such a manner that the useless sensitivity range from 500 nm towards a shorter wavelength side may be removed and photoconductive properties of the photoconductor may be exhibited in effect only in the range of 500 to 600 nm.

As such photoconductor, materials such as sulphur, selenium, oxides, sulfides or selenides of zinc, cadmium, mercury, antimony, titanium, bismuth or lead, anthracene, anthraquinone, polyvinyl carbazol, polyvinyl anthracene or polyacethylene may be used. The most preferred material is zinc oxide.

Preferably, the green light intensifier or sensitizer used for sensitizing the photoconductor has no skirt in the wavelength region higher than 600 nm. As green light intensifier, materials such as eosin, fluorescein, tetrabromofluorescein, tetrachlorofluorescein, tetrabromotetrachlorofluorescein, phloxine, erythrosine or Rhodamine B may be used. The green light intensifier may be used in an amount of 0.01 to 1 wt. part to 100 wt. parts of the photoconductive material.

Hypersensitizers may be additionally used for promoting sensitization of the green light intensifier so as to provide for so-called hypersensitization. As these hypersensitizers, compounds showing electron affinity such as benzoquinone, chloranil, phthalic anhydride, maleic anhydride, dinitrobenzoic acid, tetracyanoquinodimethane or iodine may be used in amounts of 0.01 to 1 wt. part to 100 wt. parts of the photoconductor.

As coloring materials, inorganic pigments, organic pigments, direct dyes, acid dyes, basic dyes, disperse dyes or oil colors may be used singly or in combination and in consideration occasionally of the hue or the like factors. For example, inorganic pigments such as yellow iron oxide or loess of Pigment Yellow -42 or -43, organic pigments such as Pigment Yellow - 1, -2, -3, -5, -6, -10, -12, -13, -14, -15, -16, -23, -65, or -115, oil colors such as Solvent Yellow -6, -14, -15, -16, -19, -21, -33, -56, -61, or -80, or disperse dyes such as Disperse Yellow -5, -7, -8, -23 or -60, may be used.

These coloring materials may be used in an amount of 1.0 to 100 wt. parts to 100 wt. parts of the aforementioned photoconductor.

A resinous binder may be occasionally added for binding the photoconductor and the coloring material to one another or promoting fixing on the paper and in an amount of 2 to 50 parts to 100 wt. parts of the aforementioned photoconductor. As such binder, thermoplastic resins such as acrylic resin, styrene resin, styrene-butadiene copolymer, polycarbonate resin, styrene-butadiene copolymer, polycarbonate resin, polyvinyl alcohol or polyvinyl acetate or thermosetting resins, such as urethane resin, epoxy resin or melamine resin, may be used either singly or in combination.

The cyan color toner sensitive to blue light presents a hue belonging to a range of 5.0 BG to 8.0 PB in the Munsell color notation system and shows marked sensitivity to the visible light with wavelength less than 500 nm (red light). It has a maximal point of sensitivity in the wavelength region less than 480 nm and more than 80 percent of sensitivity proper to the visible light region in the wavelength region less than 470 nm.

As practical construction of the photoconductive toner, it is advisable to use a photoconductor exhibiting specific photoconductive properties in the wavelength region less than 500 nm (blue light) by addition of a blue light intensifier or sensitizer, in which the toner contains a coloring material exhibiting substantially negligible absorption of the visible light less than 500 nm in wavelength, but exhibiting absorptive properties for the wavelength region higher than 500 nm and especially higher than 600 nm and presenting the cyan hue as mentioned above. In this case, the coloring material acts as filter with respect to photoconductivity of the photoconductive material in the range higher than 500 nm so that the photoconductor may exhibit photoconductivity only in the limited wavelength region less than 500 nm. Since the above described cyan coloring material usually exhibits strong color absorption in the region higher than 500 nm and especially higher than 600 nm, even if the photoconductor should still exhibit a useless sensitivity range towards the longer wavelength side of 500 nm after addition of the blue light intensifier, such useless sensitivity range is filtered off and removed due to absorption proper to the coloring material. Since the coloring material exhibits no color absorption in the region of increased sensitivity of the photoconductive material by the blue light intensifier, that is, the region less than 500 nm in wavelength, sensitivity of the photoconductive material is not lowered.

As photoconductor, materials such as sulphur, selenium, oxides, sulfides or selenides of zinc, cadmium, mercury, antimony, titanium, bismuth or lead, anthracene, anthraquinone, polyvinyl carbazol, polyvinyl anthracene, or polyacetylene, may be used. The most preferred material is zinc oxide.

As blue light intensifier for the photoconductor, 2-[3-(2-carboxyethyl)-2(3H)-benzothiazoliden]methyl-3-carboxylate ethyl benzothiazolium represented by a formula

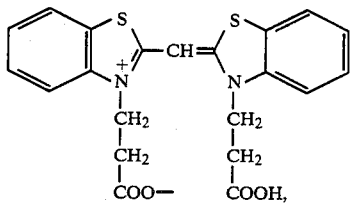

2-[3-(2-carboxyethyl)-2(3H)-benzothiazolidene]methyl-3-carboxyethylbenzothiazolium bromide, 2-[3-(2-carboxymethyl)-2-(3H)-benzothiazolidene]methyl-3-carboxylatemethylbenzothiazolium, Auramine, merocyanine, Solar Pure Yellow, Thioflavine T, Thioflavine S, Acridine Yellow, etc. may be used. These blue intensifiers may be used in an amount of 0.01 to 1.0 wt. percent related to the aforementioned photoconductor.

Hypersensitizers may be additionally used for promoting sensitization of the blue light intensifier so as to provide for so-called hypersensitization. As these hypersensitizers, compounds showing electron affinity, such as benzoquinone, chloranil, phthalic anhydride, maleic anhydride, dinitrobenzoic acid or iodine may be used. These materials can be used in an amount of 0.01 to 1.0 wt. percent relative to the aforementioned photoconductor.

As coloring materials, inorganic pigments, organic pigments, direct dyes, acid dyes, basic dyes, disperse dyes or oil colors may be used singly or in combination and in consideration occasionally of the hue or the like factors. For example, inorganic pigments such as Pigment Blue-27 (prussian blue), Pigment Blue-28 (cobalt blue), Pigment Blue-29 (ultramarine) or Pigment Blue-35 (cerulean blue); organic pigments such as Pigment Blue-2, -9, -15, -16, -18, -19, -24, -60 or -64; and organic dyes, such as oil colors, for example, Solvent Blue-2, -11, -12, -25, -35, -36, -55 or -73. These coloring materials can be used in an amount of 1.0 to 100 wt. percent related to the aforementioned photoconductor.

The aforementioned photoconductor, blue light intensifiers and coloring materials are essential ingredients of the above described photoconductive toners. In addition to these essential ingredients, a resinous binder may be occasionally used for binding these ingredients to one another or promoting fixing on the duplicating medium. As such binder, thermoplastic resins such as acrylic resin, styrene resin, styrenebutadiene copolymer, polycarbonate resin, polyvinyl alcohol or polyvinyl acetate, or thermosetting resins such as urethane resin, epoxy resin or melamine resin, may be used singly or in combination. These resins may be used in an amount of 2 to 50 wt. percent relative to the aforementioned photoconductor.

The photoconductive toners of the present invention may be prepared according to spray dry or microcapsulation methods by means of which the above described ingredients are uniformly dispersed or placed in concentrical spherical configuration within each given particle.

The present invention will be described by reference to several specific Examples of preparing three color toners. It should be noted that these Examples are given only by way of illustration and are not intended in any way for limiting the scope of the invention.

Example of Preparation of Magenta Color Photoconductive Toners sensitive to Red Light 40 weight parts of Sazex 2000 (particles of zinc oxide prepared by Sakai Kagaku Kogyo KK), 0.05 weight part of Tetrabromophenol Blue prepared by Nakarai Kagaku KK) and 80 weight parts of ethyl alcohol were despersed uniformly, ethyl alcohol used as solvent was dried, and the above Tetrabromophenol Blue used as light intensifier was adsorbed to the above zinc oxide particles.

To the dried product were added 4 weight parts of acrylic resin BR 102 used as resinous binder (prepared by Mitsubishi Rayon KK), 10 weight parts of Lionol Red (prepared by Toyo Ink KK) and 180 weight parts of acetone. The resulting product was mixed by a ball mill to a uniform liquid dispersion which was then spray dried with a miniature sprayer to particulate magenta color photoconductive toners.

Figure 9:
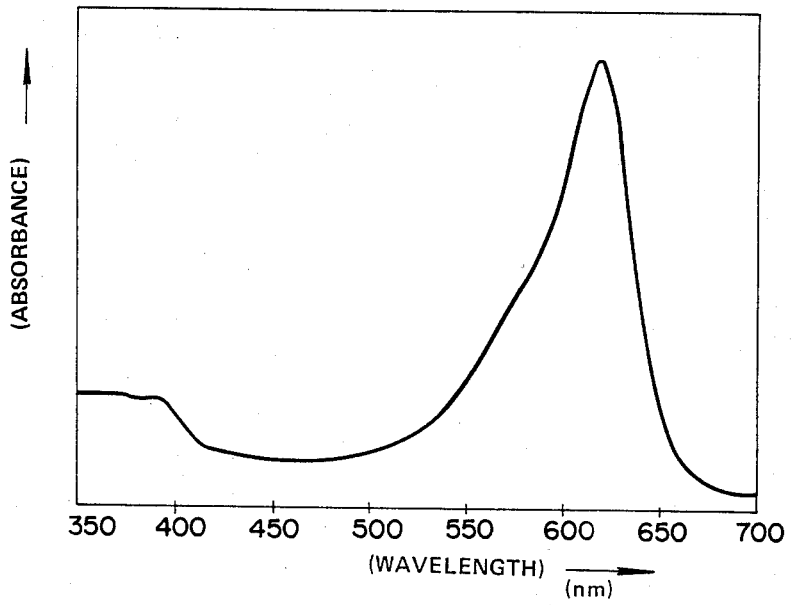
FIG. 9 is a chart showing light absorbance characteristics of Tetrabromphenol Blue.
Figure 10:
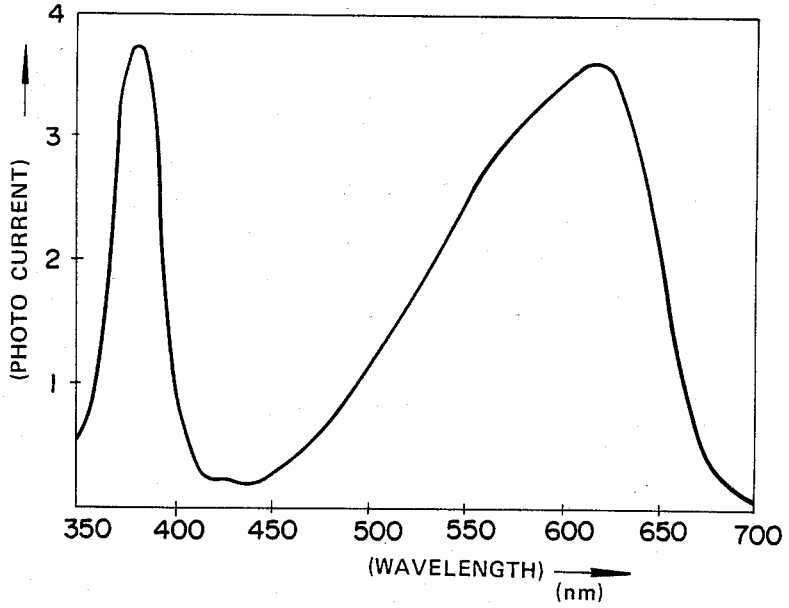
FIG. 10 is a chart showing photoconductive characteristics of zinc oxide sensitized with Tetrabromphenol Blue.
Figure 11:
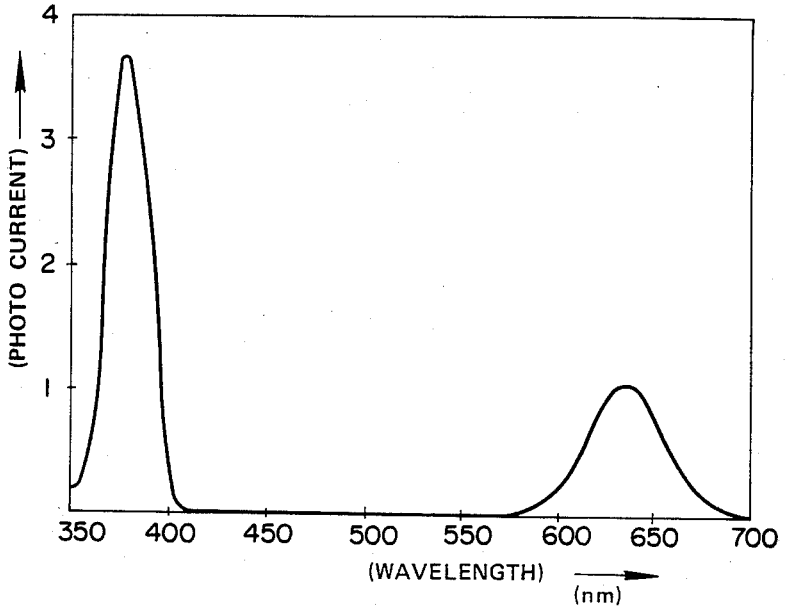
FIG. 11 is a chart showing photoconductive characteristics of photoconducting magenta toners sensitive to red light.

FIG. 9 shows light absorbance characteristics of Tetrabromophenol Blue, FIG. 10 photoconductive properties of zinc oxide intensified by Tetrabromophenol and FIG. 11 photoconductive properties of the resulting magenta color photoconductive toners.

It is seen from FIG. 11 that the magenta color photoconductive toners exhibit a sharp peak of sensitivity in the wavelength region of 600 to 700 nm.

Example of Preparing Yellow Color Photoconductive Toners Sensitive to Green Light 40 weight parts of Sazex 2000 (particles of zinc oxide prepared by Sakai Kagaku Kogyo KK), 0.2 weight part of Eosin prepared by Wako Junyaku KK) and BO weight parts of ethyl alcohol were dispersed uniformly, ethyl alcohol used as solvent was dried, and the above Eosin used as light intensifier was adsorbed to the zinc oxide particles.

To the dried product were added 4 weight parts of acrylic resin BR 102 used as resinous binder (prepared by Mitsubishi Rayon KK), 10 weight parts of Lionol Yellow (prepared by Toyo Ink KK) and 180 weight parts of acetone. The resulting product was mixed together by a ball mill to a uniform liquid dispersion which was then spray dried with a miniature sprayer to particulate magenta color photoconductive toners.

Figure 12:
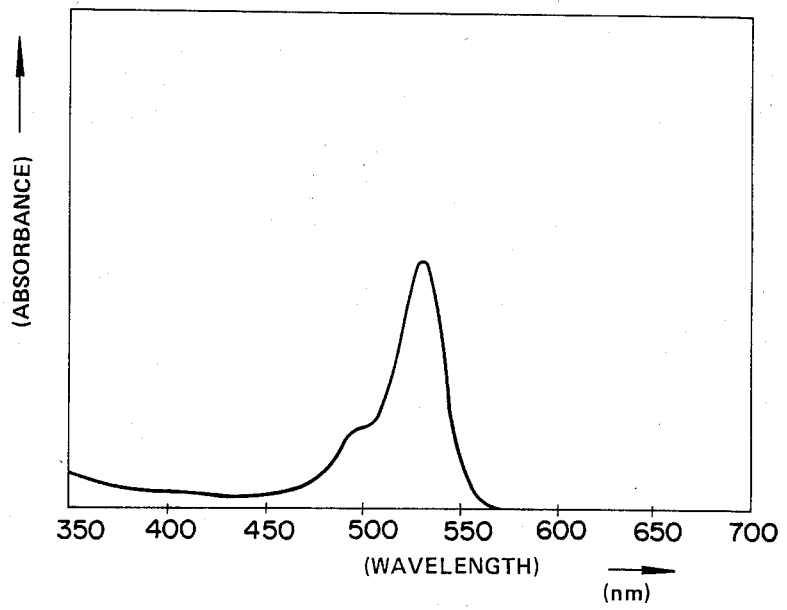
FIG. 12 is a chart showing light absorbance characteristics of Eosin.
Figure 13:
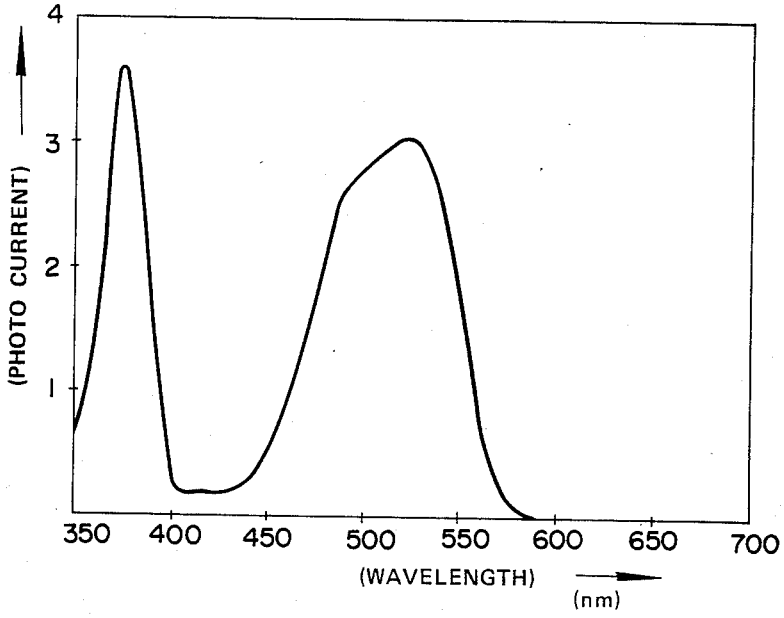
FIG. 13 is a chart showing photoconductive characteristics of zinc oxide sensitized with Eosin.
Figure 14:
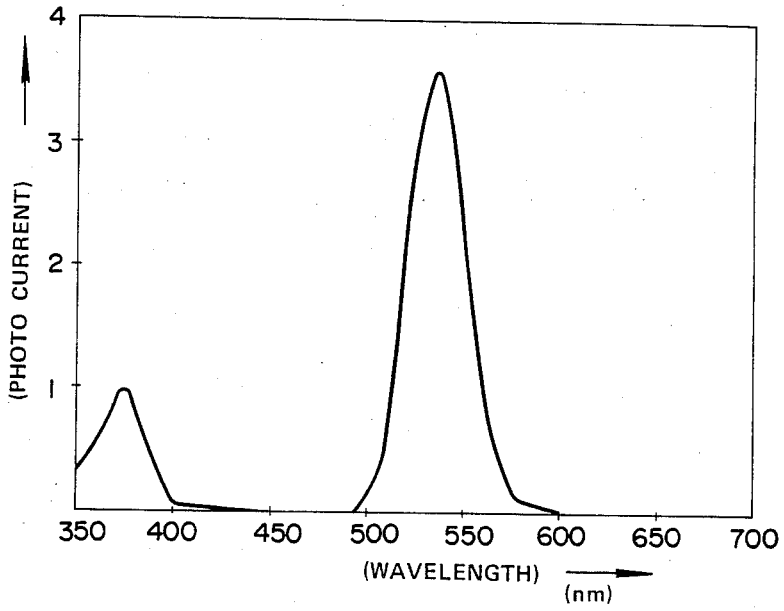
FIG. 14 is a chart showing photoconductive characteristics of light conductive yellow toners sensitive to green light.
Figure 15:
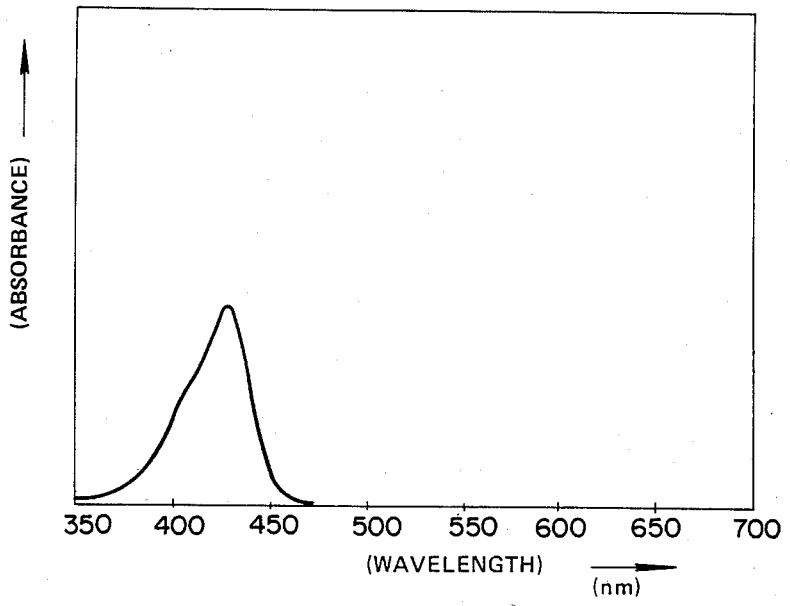
FIG. 15 is a chart showing light absorbance characteristics of Cyanin NK 1870.

FIG. 12 shows light absorbance characteristics of Eosin, FIG. 15 photoconductive properties of zinc oxide intensified by Eosin and FIG. 14 photoconductive properties of the resulting yellow color photoconductive toners.

It is seen from FIG. 14 that the yellow color photoconductive toners exhibit a sharp peak of sensitivity in the wavelength range of 500 to 580 nm.

Example of Preparing Cyan Color Photoconductive Toners Sensitive to Blue Light 40 weight parts of Sazex 2000 (particles of zinc oxide prepared by Sakai Kagaku KK), 0.2 weight part of Cyanine NK 1870 (prepared by Nippon Kanko Shikiso KK) and 80 weight parts of ethyl alcohol were dispersed uniformly, ethyl alcohol used as solvent was dried, and the above Cyanine NK 1870 used as light intensifier was adsorbed to the zinc oxide particles.

To the dried product were added 4 weight parts of acrylic resin BR 102 used as resinous binder (prepared by Mitsubishi Rayon KK), 10 weight parts of Lionol Blue (prepared by Toyo Ink KK) and 180 weight parts of acetone. The resulting product was mixed together by a ball mill to a uniform liquid dispersion which was then spray dried with a miniature sprayer to particulate cyan color photoconductive toners.

Figure 16:
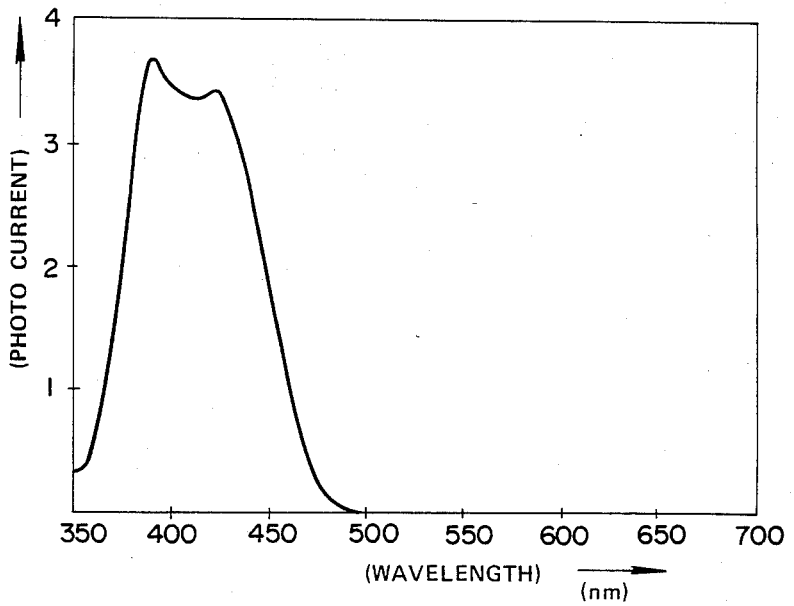
FIG. 16 is a chart showing photoconductive characteristics of zinc oxide sensitized with Cyanin NK 1870.
Figure 17:
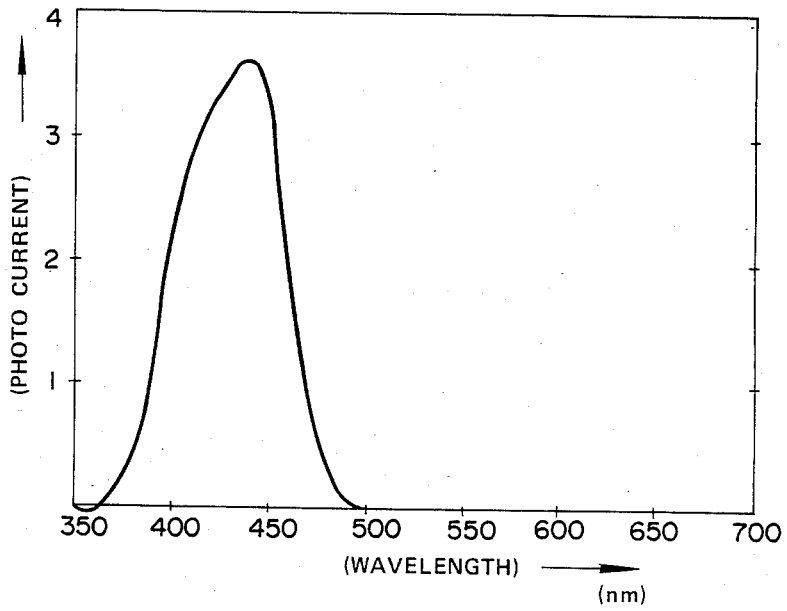
FIG. 17 is a chart showing photoconductive cyan toners sensitive to blue light.

FIG. 15 shows light absorbance characteristics of Cyanine NK 1870, FIG. 16 photoconductive properties of zinc oxide intensified by Cyanine NK 1870 and FIG. 17 photoconductive properties of the resulting cyan color photoconductive toners.

It is seen from FIG. 17 that the cyan color photoconductive toners exhibit a sharp peak of light sensitivity in the wavelength range of 400 to 480 nm.

The three different photoconductive toners thus prepared were sprayed on an ordinary paper sheet and irradiated with three color light beams, that is, red, green and blue light beams. After irradiation, toner particles from which charges were lost were removed and the remaining toner particles were fixed on the paper sheet. The portions irradiated with red, green and blue light beams were colored in green, blue and red, respectively.

What is claimed is:

1. A method for forming a colored image comprising the steps of:

(a) uniformly forming three kinds of photoconductive toners on a substrate, each of said photoconductive toners having an absorption wavelength band corresponding to one of red, green and blue light components of a natural light, each of said photoconductive toners having a sensitization wavelength band corresponding to one of red, green and blue light components of the natural light, and each of said photoconductive toners having said absorption wavelength band and said sensitization wavelength band different from each other;

(b) uniformly charging said photoconductive toners;

(c) obtaining three colors corresponding to three primary colors, that is, red, green, blue, from an original image to be reproduced;

(d) converting said three primary colors into three primary colors mutually different therefrom;

(e) exposing said photoconductive toners to a light with each of the converted three primary colors for selectively removing charges from a portion of said photoconductive toners; and (f) removing toners freed of charges from said substrate.

2. The method according to claim 1 in which said absorption wavelength band convers shorter wavelength band than said sensitization wavelength band when the both are adjacent to each other.

3. The method according to claim 1 in which said three kinds of photoconductive toners are composed of a first toner having its sensitization peak in the wavelength band ranging from 600 nm to 700 nm and its absorption peak in the wavelength band ranging from 500 nm to 600 nm, a second toner having its sensitization peak in the wavelength band ranging from 500 nm to 600 nm and its absorption peak in the wavelength band ranging from 400 nm to 500 nm and a third toner having its sensitization peak in the wavelength band ranging from 400 nm to 500 nm and its absorption peak in the wavelength band ranging from 600 nm to 700 nm.

4. The method according to claims 1, 2 and 3 in which said original image is separated into three primary color components, that is, red, green and blue components, said red component is converted into blue light, said green component is converted into red light, and said blue component is converted into green light, and thus obtained converted blue, red and green light is irradiated to said photoconductive toners.

5. The method according to claim 4 in which said original image is picked up and separated into three primary color component video signals, that is, a red signal, a green signal, and a blue signal, blue light is generated according to said red signal, red light is generated according to said green signal, and green light is generated according to said blue signal.

6. A photosensitive material employed in the method for forming a color image comprising a substrate and three kinds of photoconductive toners uniformly formed on said substrate, each of said photoconductive toners having an absorption wavelength band corresponding to one of red, green and blue light components of a natural light, each of said photoconductive toners having a sensitization wavelength band corresponding to one of red, green and blue light components of the natural light, and each of said photoconductive toners having said absorption wavelength band and said sensitization wavelength band different from each other.

7. The photosensitive material according to claim 6 in which said absorption wavelength band covers shorter wavelength band than said sensitization wavelength band when the both are adjacent to each other.

8. The photosensitive material according to claim 6 in which said three kinds of photoconductive toners are composed of a first toner having its sensitization peak in the wavelength band ranging from 600 nm to 700 nm and its absorption peak in the wavelength band ranging from 500 nm to 600 nm, a second toner having its sensitization peak in the wavelength band ranging from 500 nm to 600 nm and its absorption peak in the wavelength band ranging from 400 nm to 500 nm and a third toner having its sensitization peak in the wavelength band ranging from 400 nm to 500 nm and its absorption peak in the wavelength band ranging from 600 nm to 700 nm.

* * * * *